United States Patent [19]

Walsh-Smith

[11] Patent Number: 5,061,103

[45] Date of Patent: Oct. 29, 1991

[54] MASCARA APPLICATOR

[75] Inventor: Margaret M. Walsh-Smith, Bridgeport, Conn.

[73] Assignee: Chesebrough-Pond's USA Co., Greenwich, Conn.

[21] Appl. No.: 220,109

[22] Filed: Jun. 27, 1988

Related U.S. Application Data

[63] Continuation of Ser. No. 11,571, Feb. 6, 1987, abandoned.

[51] Int. Cl.[5] ..... A46B 11/00

[52] U.S. Cl. ..... 401/122; 401/127

[58] Field of Search ..... 401/122, 127; 222/148, 222/151; 215/247

[56] References Cited

U.S. PATENT DOCUMENTS

| | | | |
|---|---|---|---|
| 2,598,447 | 1/1951 | Finney | 401/127 |
| 2,644,183 | 7/1953 | Kellett | 401/122 X |
| 3,415,604 | 12/1968 | Ahrens et al. | 401/122 |
| 3,694,096 | 9/1972 | Seidler | 401/127 |
| 3,892,248 | 7/1975 | Kingsford | 132/88.7 |
| 3,896,823 | 7/1975 | Spatz | 132/88.7 |
| 3,958,572 | 5/1976 | Lawhead | 215/247 X |
| 4,066,183 | 1/1978 | Armstrong | 215/247 |
| 4,187,149 | 2/1980 | Tolbert et al. | 215/247 X |
| 4,617,948 | 10/1986 | Gueret | 401/122 X |

FOREIGN PATENT DOCUMENTS

| | | | |
|---|---|---|---|
| 2285101 | 4/1976 | France | 401/122 |
| 804192 | 11/1958 | United Kingdom . | |
| 1397930 | 6/1975 | United Kingdom | 222/148 |

*Primary Examiner*—Steven A. Bratlie

*Attorney, Agent, or Firm*—Melvin H. Kurtz; Daniel S. Ortiz

[57] ABSTRACT

A mascara applicator is described comprising a container for the mascara containing a silicone elastomer wiper gland in the opening of the container which allows for ingress and egress of an applicator brush and its attached stem. The applicator also comprises a cap for the opening of the container to which is attached to the stem and brush for the applicator.

5 Claims, 1 Drawing Sheet

MASCARA APPLICATOR

This application is a continuation of application Ser. No. 011,571, filed 2/6/87, abandoned.

BACKGROUND OF THE PRESENT INVENTION

1. Field of the Present Invention

The present invention relates to a mascara applicator having an improved wiper gland assembly.

2. Description of the Prior Art

Various references exist to mascara applicators having wiper gland components which are designed to remove excess mascara from either the applicator brush, the shaft holding the applicator brush, or both. For example, U.S. Pat. No. 3,892,248 describes an eyelash-cosmetic applicator which utilizes a wiper assembly constructed of a neoprene material so as to afford resistance to organic solvents. U.S. Pat. No. 3,896,823 describes a cosmetic applicator having an elastic wiper made of synthetic rubber (such as Buna-N rubber). British Patent No. 804,192 shows a mascara applicator and teaches that the stem holding the applicator brush passes through an aperture in a rubber or a "polythene" stopper so that, on withdrawal, the stem is wiped substantially clean by the stopper. The reference to "polythene" in this British patent is intended to teach the use of polyethylene as a material in a wiper gland assembly.

The foregoing patents illustrate that wiper glands for mascara packages are conventionally made of polyethylene, Buna-N rubber, or neoprene rubber. Such materials have certain disadvantages.

For example, rubber wiper glands formed of either Buna-N or neoprene rubbers tend to become stretched upon prolonged usage such that they are no longer effective in removing excess mascara so that undesired globules of mascara exist on either the applicator brush, the shaft holding the applicator brush, or both. Also, Buna-N or neoprene rubber wipers tend to give off an offensive odor over time due to the contact of these rubber materials with the mascara formulation.

Polyethylene wiper glands are relatively non-flexible. The orifice of the wiper can be enlarged with use and take a set. Therefore, the orifice size is dictated by the size of the rod and the brush must be larger in diameter than the rod to obtain an effective wipe.

SUMMARY OF THE PRESENT INVENTION

The present invention relates to a mascara applicator comprising a container for mascara having an opening at one end to allow for ingress and egress of an applicator brush and attached stem, the container comprising a wiper gland formed of silicone elastomer. The wiper gland can be of conventional design having an opening therein to allow for ingress and egress of the brush and attached stem to achieve removal of excess mascara therefrom. The applicator also contains a cap for the opening of the container with the stem and attached brush being mounted to the inner surface of the cap.

The use of a silicone elastomer for the wiper gland in accordance with the present invention provides certain unexpected advantages as compared to conventional wiper gland assemblies. A silicone wiper gland provides unique properties in that it is very flexible, has an excellent memory, and does not stretch or take a set. This is quite important, particularly in preferred embodiments of the present invention where a relatively thick rod is used with a very slim brush due to a retractable mechanism which allows for retraction of the brush into the stem. The use of a silicone wiper gland is also desirable since it does not give off an offensive odor, as does Buna-N or neoprene rubber wipers, when placed in prolonged contact with mascara formulations.

DESCRIPTION OF THE DRAWINGS

The present invention is further understood by the Drawings which form a portion of the present specification wherein.

DETAILED DESCRIPTION OF THE PRESENT INVENTION

Figure 1:
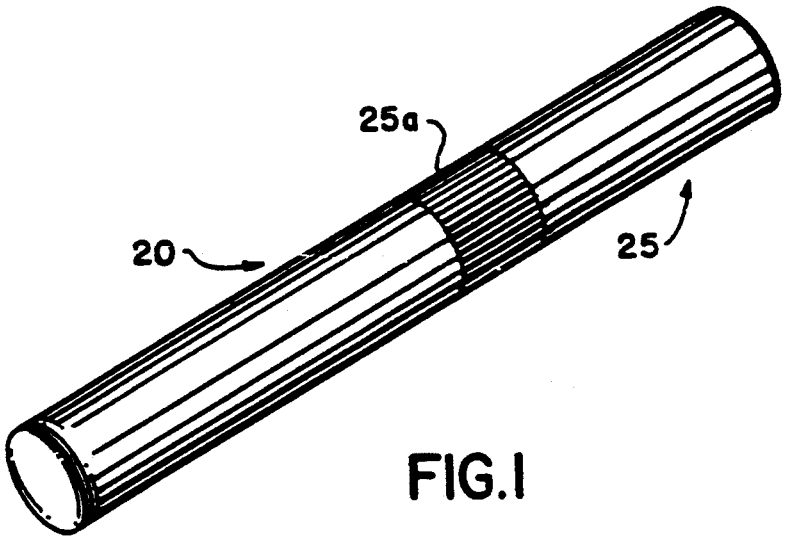
FIG. 1 is a perspective view showing a preferred mascara applicator of the present invention.
Figure 2:
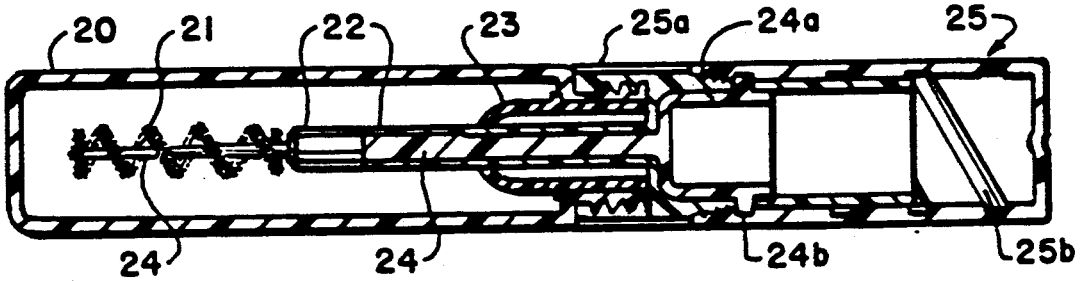
FIG. 2 is a cross-sectional view showing the preferred mascara applicator with the cap joined to the container and with the brush in its fully extended position.
Figure 3:
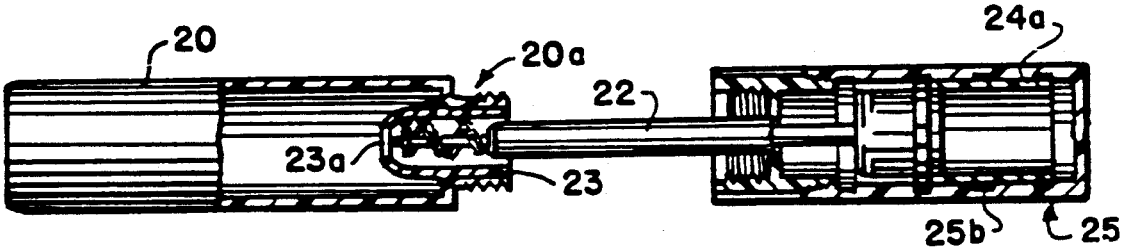
FIG. 3 is a cross-sectional view showing the cap for the preferred mascara applicator removed from the container with the brush in a more retracted position than shown in FIG. 2.

FIGS. 1–3 illustrate a preferred embodiment of the mascara applicator of the present invention.

FIG. 1 shows the applicator in perspective view. It comprises a container 20 and cap 25. The cap 25 has a rotatable portion **25*a* which is best seen in FIGS. 2 and 3. Rotation of portion 25*a*** (which is integral with an outer stem member) retracts and extends an applicator brush carried on an inner stem within the outer stem.

FIGS. 2 and 3 illustrate the device in more detail, especially the retractible/extendible brush feature carried by cap 25.

The container 20 is adapted to hold a suitable mascara formulation (not shown) within it. The container has a threaded neck **20*a* to which the cap 25 can be attached. The silicone elastomer wiper gland 23 of the present invention is placed inside container 20 adjacent the neck 20*a*. The wiper gland 23 has an opening 23*a* for ingress and egress of brush 21 carried on inner stem 24 as well as hollow outer stem 22** in which the inner stem/brush is retractible/extendible. Silicone elastomers (also termed "silicone rubbers") are siloxane polymers composed of a central chain of alternating silicon and oxygen atoms with alkyl groups attached to the silicon atoms. Although such materials have found use in biomedical and other applications, their use in connection with the present invention represents a substantial departure in terms of both their usage as well as the advantages realized therefrom.

As stated earlier, the cap 25 carries the retractible/extendible brush assembly which is preferred for the present invention. It is to be understood, however, that the discovery of the advantages of a silicone wiper gland, although of prime importance with regard to the particular preferred embodiment, also has similar advantages in regard to its desirable performance features in other, differing mascara applicators which rely upon the presence of a wiper gland assembly in a mascara container to wipe clean a mascara brush and/or mascara brush stem inserted therethrough. In the preferred embodiment shown in FIGS. 2 and 3, the brush 21 is carried by an inner stem 24 which lies within a larger, hollow outer stem 22. The rear portion **24*a* of the inner stem 24 has protruding tongue members 24*b* which mate with recessed and slanted screw threads 25*b* on the inner surface of the cap 25. Rotation of portion 25*a*, which is integral with the outer stem 22, relative to cap 25 moves the tongue members 24*b* along the slanted screw threads 25*b*. This translates into a coaxial movement of inner stem 24 and attached brush 21 relative to outer stem 22 so as to alternatively retract or extend the brush 21**.

The orifice **23*a* of wiper gland 23 wipes excess mascara from the outer stem 22**, in particular, of the described structure. This is quite important in the preferred construction wherein a relatively thicker outer stem is needed to encase the thinner inner stem holding the retractible/extendible brush/stem arrangement. In more conventional mascara applicators, which do not have such a thick stem, a silicone elastomer wiper gland would still have substantial utility and advantages since it would tend to have an orifice which would remove excess mascara from the applicator brush itself to a greater degree rather than from the thinner shaft holding such a brush. However, the good retention of shape and non-odorous nature of such a novel wiper gland component would still have superior utility in such environments.

The foregoing should be taken as merely illustrative of the present invention rather than limiting thereof. The scope of protection that is sought is set forth in the claims which follow.

I claim:

1. A mascara applicator which comprises:

(a) a container for mascara having an opening at one end thereof to allow for ingress and egress of an applicator brush and attached stem, the container comprising a wiper gland consisting of a essentially silicone elastomer adjacent the container opening, said wiper gland having an opening therein to allow for ingress and egress of the brush and attached stem therethrough to achieve the removal of excess mascara; and (b) a cap member for the opening of the container, the stem and attached brush being mounted to the inner surface of the cap member.

2. A mascara applicator as claimed in claim 1 which comprises an inner stem holding said brush which is retractible within a hollow, thicker outer stem.

3. A mascara applicator as claimed in claim 2 wherein a portion of the inner stem has tongue means which cooperate with groove means on the inside surface of the cap to achieve relative movement of the inner stem and brush relative to the outer stem.

4. A mascara container which comprises an opening at one end thereof and, located within the container opening, a wiper gland consisting of a essentially silicone elastomer which has an opening therein to allow for ingress and egress of a mascara brush and stem holding said brush.

5. A mascara container as claimed in claim 4 which has a threaded neck at its opening to allow for closure of the opening by a cap holding the brush and stem.

* * * * *